US008083822B2

(12) United States Patent
Hoffman et al.

(10) Patent No.: US 8,083,822 B2
(45) **Date of Patent: *Dec. 27, 2011**

(54) SYSTEM FOR TREATING EXHAUST GAS

(75) Inventors: Loran Hoffman, Washington, IL (US); Richard A. Crandell, Peoria, IL (US); Thomas V. Staley, Peoria, IL (US); Ryan M. Duffek, Peterborough (GB)

(73) Assignee: Caterpillar Inc., Peoria, IL (US)

( * ) Notice: Subject to any disclaimer, the term of this patent is extended or adjusted under 35 U.S.C. 154(b) by 166 days.

This patent is subject to a terminal disclaimer.

(21) Appl. No.: 12/397,859

(22) Filed: Mar. 4, 2009

(65) Prior Publication Data

US 2009/0223212 A1 Sep. 10, 2009

Related U.S. Application Data

(60) Provisional application No. 61/068,329, filed on Mar. 6, 2008.

(51) Int. Cl.
*B01D 50/00* (2006.01)
*B01D 53/34* (2006.01)
*F02M 35/024* (2006.01)

(52) U.S. Cl. ..... 55/385.3; 55/498; 55/DIG. 28; 55/DIG. 30; 123/184.57; 123/198 E; 181/228; 181/229; 422/168; 422/169; 422/177; 422/179; 422/180; 60/297; 60/299; 60/311; 285/407; 285/420

(58) Field of Classification Search ..... 55/385.3, 55/498, DIG. 28, DIG. 30; 123/198 E, 184.57; 181/228, 229; 422/168, 169, 177, 179, 180; 60/297, 299, 311; 285/407, 420
See application file for complete search history.

(56) References Cited

U.S. PATENT DOCUMENTS 3,420,052 A 1/1969 Miller
3,607,133 A 9/1971 Hirao et al.
3,852,042 A 12/1974 Wagner (Continued)

FOREIGN PATENT DOCUMENTS

EP 1 596 044 A1 11/2005

(Continued)

OTHER PUBLICATIONS

English-language Abstract of FR 2 843 776 A1, Aug. 2002.

(Continued)

*Primary Examiner* — Robert A Hopkins
*Assistant Examiner* — Minh-Chau Pham
(74) *Attorney, Agent, or Firm* — Finnegan, Henderson, Farabow, Garrett & Dunner LLP

(57) ABSTRACT

A system for treating exhaust gas from an engine is disclosed. The system may include a housing, a fluid treatment element, and a conduit. The housing has an inlet and an outlet port and defines a flow path therebetween. The fluid treatment element is arranged in the flow path. The conduit is fluidly connected with at least one of the inlet port and the outlet port and includes a first port having a first axis and a second port having a second axis substantially perpendicular to the first axis. The first port has a first cross-section with an inner diameter. The second port has a second cross-section with an inner width and an inner length. The inner length of the second cross-section is smaller than the inner diameter of the first cross-section, and the inner width of the second cross-section is greater than the inner diameter of the first cross-section.

20 Claims, 6 Drawing Sheets

U.S. PATENT DOCUMENTS

| | | | | |
|---|---|---|---|---|
| 3,892,536 | A | 7/1975 | Roeser et al. | |
| 5,043,146 | A * | 8/1991 | Ishikawa et al. | 422/176 |
| 5,921,214 | A * | 7/1999 | Fujita et al. | 123/198 E |
| 6,712,869 | B2 | 3/2004 | Cheng et al. | |
| 6,767,378 | B2 | 7/2004 | Nishiyama et al. | |
| 6,824,743 | B1 | 11/2004 | Pawson et al. | |
| 6,883,311 | B2 | 4/2005 | Liu | |
| 6,887,294 | B2 | 5/2005 | Kanematsu | |
| 7,062,904 | B1 | 6/2006 | Hu et al. | |
| 7,150,260 | B2 * | 12/2006 | Arevalo et al. | 123/198 E |
| 7,299,626 | B2 | 11/2007 | Barasa et al. | |
| 7,501,005 | B2 * | 3/2009 | Thaler | 55/523 |
| 2005/0150211 | A1 | 7/2005 | Crawley et al. | |
| 2005/0178111 | A1 | 8/2005 | Kammel | |
| 2006/0277900 | A1 | 12/2006 | Hovda et al. | |
| 2007/0039316 | A1 | 2/2007 | Bosanee, Jr. et al. | |
| 2007/0137187 | A1 | 6/2007 | Kumar | |
| 2007/0175187 | A1 * | 8/2007 | Kopec et al. | 55/385.3 |
| 2008/0072580 | A1 | 3/2008 | Nagaoka et al. | |
| 2008/0138256 | A1 * | 6/2008 | Salasc et al. | 422/168 |
| 2008/0155973 | A1 | 7/2008 | Maruyama et al. | |
| 2008/0178585 | A1 | 7/2008 | Bruza et al. | |
| 2009/0084344 | A1 * | 4/2009 | Fasan | 123/198 E |

FOREIGN PATENT DOCUMENTS

| | | | |
|---|---|---|---|
| EP | 1965046 | | 9/2008 |
| FR | 2 843 776 | A1 | 2/2004 |
| JP | 58-076122 | | 5/1983 |
| WO | 01/83957 | | 11/2001 |
| WO | WO 2006/027460 | A1 | 3/2006 |
| WO | WO 2007/078411 | A2 | 7/2007 |
| WO | WO 2008/025920 | A1 | 3/2008 |

OTHER PUBLICATIONS

PCT Search Report mailed Sep. 28, 2009, Application No. PCT/US2009/036202 filed Mar. 5, 2009.

Thiesel 2002 Conference on Thermo- and Fluid-Dynamic Processes in Diesel Engines, "An Integrated Approach for the Design of Diesel Engine Exhaust Systems to meeting Euro 4 and Beyond Emissions Legislations," pp. 1-15.

Photos of exhaust treatment arrangements displayed by a non-Caterpillar companies at the Mid-America Trucking Show on Mar. 22, 2007 in Louisville, Kentucky (2 sheets).

* cited by examiner

SYSTEM FOR TREATING EXHAUST GAS

RELATED APPLICATIONS

The present disclosure claims the right to priority based on U.S. Provisional Patent Application No. 61/068,329 filed Mar. 6, 2008, which is expressly incorporated herein by reference in its entirety.

TECHNICAL FIELD

This disclosure relates generally to a system for treating gas and, more particularly, to a system for effectively and efficiently treating exhaust gas from an engine.

BACKGROUND

Exhaust treatment systems for treating exhaust gas from an engine are typically mounted downstream from an engine and may include a diesel particulate filter or some other exhaust treatment element or elements arranged within the flow path of exhaust gas. The exhaust gas is typically forced through the exhaust treatment element to positively impact the exhaust gas, for example by reducing the amount of particulate matter or NOx introduced into atmosphere as a result of engine operation.

Exhaust treatment systems may be designed for (i) maximum positive effect on engine exhaust gas and (ii) minimal negative impact on engine performance. For example, exhaust treatment systems may be designed with diffuser elements and/or various complex geometries intended to better distribute exhaust flow across the face of an exhaust treatment element while minimally impacting exhaust flow resistance.

U.S. Pat. No. 6,712,869 to Cheng et al. discloses an exhaust aftertreatment device with a flow diffuser positioned downstream of an engine and upstream of an aftertreatment element. The diffuser of the '869 patent is intended to de-focus centralized velocity force flow against the aftertreatment element and even out an exhaust flow profile across the aftertreatment element. The disclosed design of the '869 patent is intended to enable a space-efficient and flow-efficient aftertreatment construction.

It may be desirable to use an improved exhaust treatment system that effectively impacts exhaust gas while minimally impacting engine performance. Moreover, it may be desirable to use an improved exhaust treatment system that accomplishes desired performance characteristics in a cost-effective and practically manufacturable manner.

The present disclosure is directed, at least in part, to various embodiments that may achieve desirable impact on aftertreatment effectiveness while improving one or more aspects of prior systems.

SUMMARY

According to one exemplary embodiment, a system for treating exhaust gas from an engine comprises a housing, a fluid treatment element, and a conduit. The housing has an inlet port and an outlet port and defines a flow path between the inlet port and the outlet port. The fluid treatment element is arranged in the flow path of the housing and is configured to treat exhaust gas. The conduit is fluidly connected with at least one of the inlet port and the outlet port of the housing. The conduit includes a first port having a first axis and a second port having a second axis substantially perpendicular to the first axis. The first port has a first cross-section with an inner diameter. The second port has a generally elongated second cross-section with an inner width and an inner length. The inner length of the second cross-section of the conduit is smaller than the inner diameter of the first cross-section of the conduit, and the inner width of the second cross-section is greater than the inner diameter of the first cross-section.

According to another exemplary embodiment, a system for treating exhaust gas from an engine comprises a housing, a fluid treatment element, and a conduit. The housing has an inlet port and an outlet port and defines a flow path between the inlet port and the outlet port. The housing also defines a longitudinal axis. The fluid treatment element is arranged in the flow path of the housing and is configured to treat exhaust gas. The conduit is fluidly connected with one of the inlet port and the outlet port of the housing. The first conduit has a first port and a second port, the first port having a first cross-section defined by an inner diameter and the second port having a second cross-section defined by an inner width and an inner length. The first cross-section is provided in a first plane and the second cross-section is provided in a second plane substantially perpendicular to the first plane. The inner width of the second cross-section is larger than the inner length of the second cross-section. A projection of the first cross-section onto the longitudinal axis of the housing is closer to the other one of the inlet port and the outlet port than a projection of the second cross-section on the longitudinal axis.

Although the drawings depict exemplary embodiments or features of the present disclosure, the drawings are not necessarily to scale, and certain features may be exaggerated in order to provide better illustration or explanation. The exemplifications set out herein illustrate exemplary embodiments or features, and such exemplifications are not to be construed as limiting the inventive scope in any manner.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts. It should be appreciated that the terms "width" and "length" as used herein do not necessarily mean the shortest dimension or the longest dimension, respectively, and are merely used in conjunction with the drawings and the explanations herein to help describe and compare various relative dimensions of an embodiment. It should also be appreciated that the term "diameter" as used herein does not necessarily connote a circular cross-section.

Figure 1:
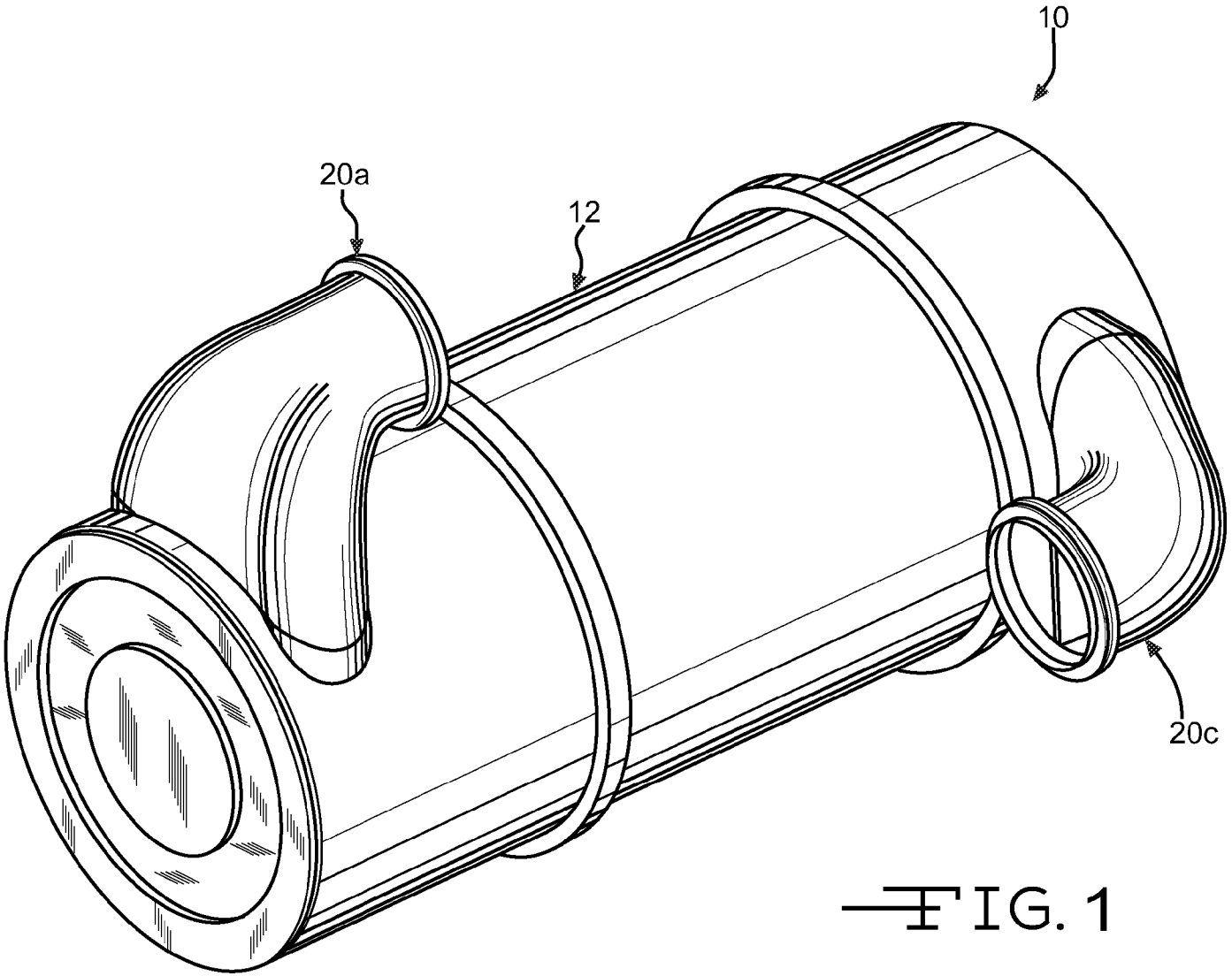
FIG. 1 is an isometric view of an exhaust treatment system according to one exemplary embodiment.
Figure 2:
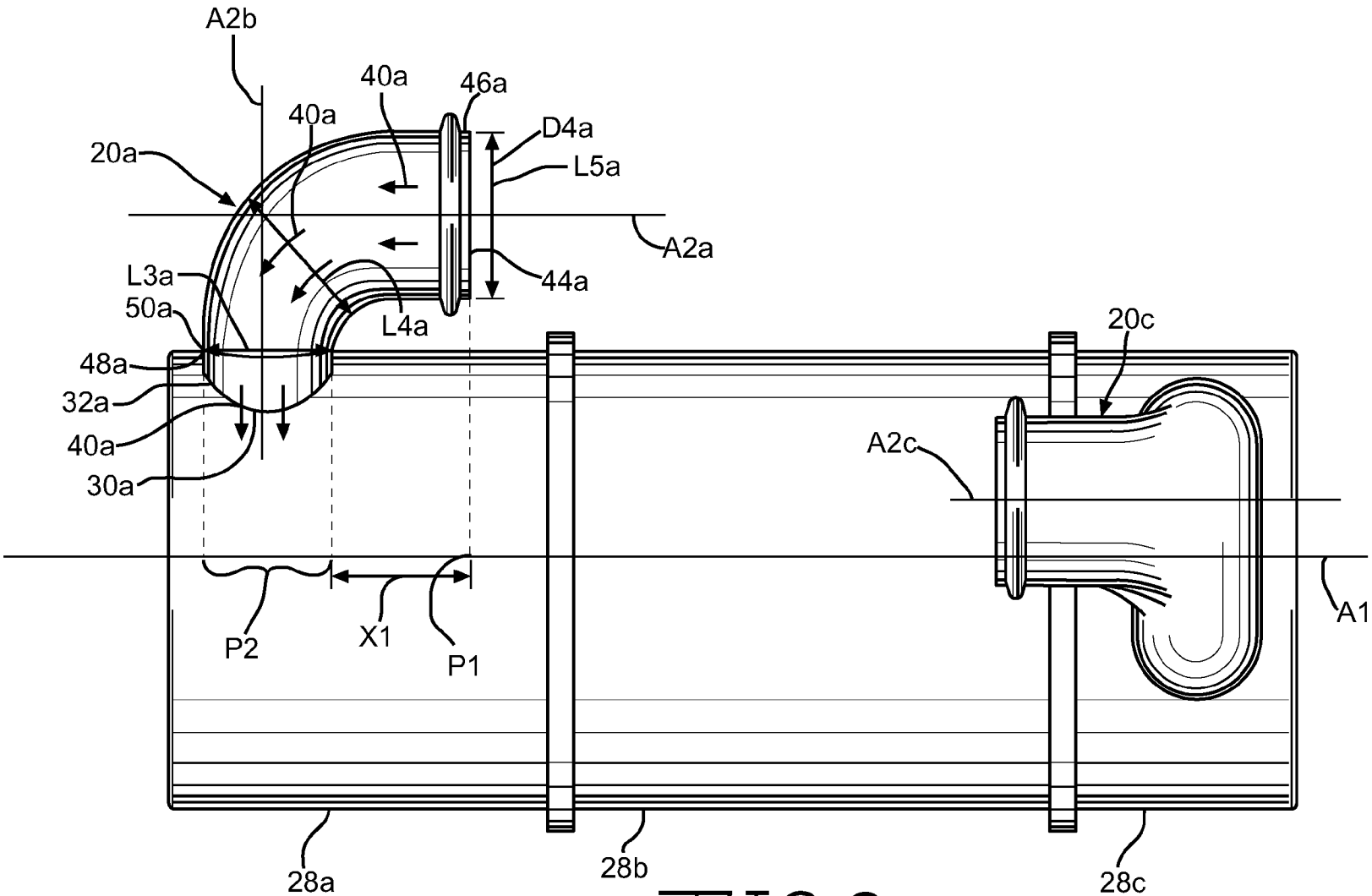
FIG. 2 is a side view of the exhaust treatment system of FIG. 1.
Figure 3:
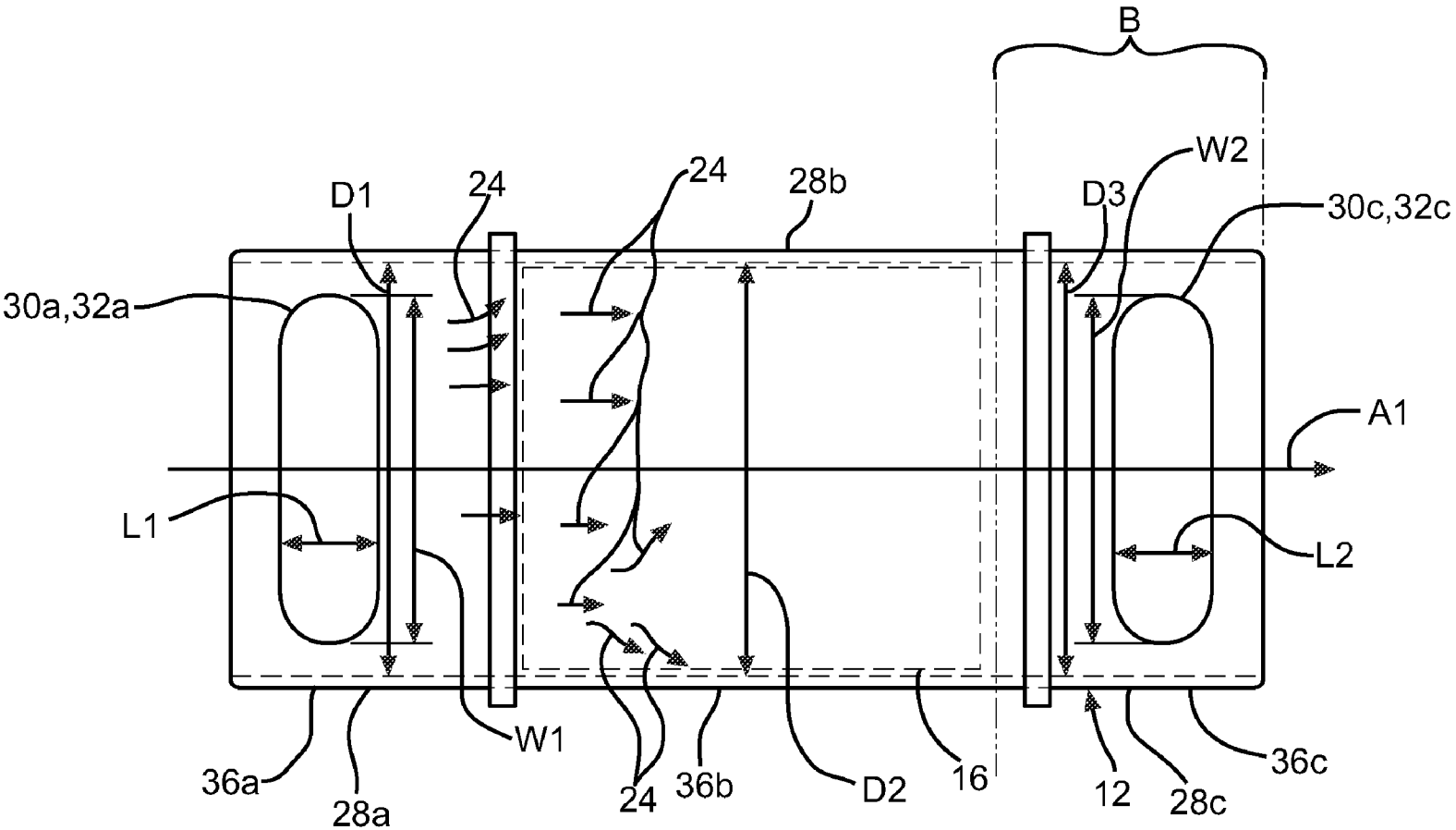
FIG. 3 is a schematic top view of a portion of the exhaust treatment system of FIG. 1 in which a portion B of the exhaust treatment system is shown rotated relative to its position in FIG. 1 to facilitate the illustration and discussion of the exhaust treatment system.

Referring now to FIGS. 1, 2, and 3, an exhaust treatment system 10 configured for treating exhaust gas from an engine is shown. The system may generally include a housing 12, a fluid treatment element 16 arranged within the housing 12, and inlet and outlet conduits 20*a*, 20*c* for communicating exhaust gas to and from the housing 12.

The housing 12 may generally define a longitudinal axis A1, along which the length of the housing 12 may generally extend. In one embodiment, the housing 12 may be formed from one or more generally cylindrical housing members 28*a*, 28*b*, 28*c* having generally tubular walls 36*a*, 36*b*, 36*c* that may cooperate to define a flow path 24 within the housing 12 extending generally along or generally parallel to the longitudinal axis A1. It should be appreciated that exhaust gas may flow in various directions at specific locations within the housing 12, and that the general resulting flow path 24 of exhaust gas through the housing 12 may be in a direction generally along or generally parallel to the longitudinal axis A1, i.e., away from the inlet conduit 20*a* and toward the outlet conduit 20*c*. The tubular walls 36*a*, 36*b*, 36*c* may each have an internal diameter D1, D2, D3 extending generally transverse to the flow path 24. The housing members 28*a*, 28*b*, 28*c* may be detachable from one another so that access to an interior portion of the housing 12 may be obtained, for example to service the system 10 or fluid treatment element 16.

As best seen in FIG. 3, the housing 12 may have a first opening 30*a* through the generally tubular wall 36*a* to form an inlet port 32*a* and may have a second opening 30*c* through the generally tubular wall 36*c* to form an outlet port 32*c*. Thus, exhaust gas may be received into housing 12 through the inlet port 32*a* and may be discharged from housing 12 through the outlet port 32*c*. Between the inlet port 32*a* and the outlet port 32*c*, exhaust gas may flow along the generally longitudinal flow path 24 away from the inlet port 32*a* and toward the outlet port 32*c*. Since a fluid treatment element 16 may be arranged within the housing 12 and in the flow path 24, exhaust gas may be forced through the fluid treatment element 16 as it passes through the housing 12.

The first and second openings 30*a*, 30*c* forming the inlet port 32*a* and the outlet port 32*c* may be generally elongated. Each opening 30*a*, 30*c* may have a length L1, L2 (for example measured in a direction generally parallel with the longitudinal axis A1) and may have a width W1, W2 (for example measured in a direction generally parallel with an internal diameter D1 of the housing 12) greater than the respective length L1, L2. In one embodiment, the opening 30*a* may have a width W1 greater than or equal to 40 percent of the inner diameter D1 of the tubular wall 36*a* of the housing 12. For example, the width W1 may be greater than or equal to 50 percent of the inner diameter D1 of the tubular wall 36*a* of the housing 12. In another embodiment, the width W1 may be greater than or equal to 60 percent of the inner diameter D1 of the tubular wall 36*a* of the housing 12. In another embodiment the width W1 may be greater than or equal to 70 percent of the inner diameter D1 of the tubular wall 36*a* of the housing 12. In one example, the width W1 could be approximately 175 mm, while the inner diameter D1 of the tubular wall 36*a* of the housing could be approximately 245 mm, so that the width W1 would be approximately equal to 71 percent of the inner diameter D1 of the tubular wall 36*a* of the housing. It yet another embodiment, the width W1 may be greater than or equal to 80 percent of the inner diameter D1 of the tubular wall 36*a* of the housing 12.

It should be appreciated that in some embodiments the openings 30*a*, 30*c* may have the same or substantially the same configuration. Alternatively, the openings 30*a*, 30*c* may have similar or substantially different configurations. For example, opening 30*c* may be the same width as, wider, or narrower than opening 30*a* and may be the same length as, or be longer or shorter than opening 30*a*.

As referenced above, the fluid treatment element 16 may be arranged in the flow path 24 of the housing 12 and may be configured to treat exhaust gas from an engine. For example, the fluid treatment element 16 may be a filter element configured to remove particulate matter from exhaust gas. The element 16 may further or alternatively be a catalyzed substrate for catalyzing NOx, hydrocarbons, or other exhaust gas constituents. Further or alternatively, the element 16 may be any type of element for treating exhaust gas from an engine, for example by removing, storing, oxidizing, or otherwise interacting with exhaust gas to accomplish or help accomplish a desired impact on the exhaust gas or a constituent thereof. In other embodiments, the fluid treatment element may be made up of two or more separate elements that cooperate together to treat the exhaust gas. For example, the fluid treatment element may include a filter element (e.g., a diesel particulate filter) and a separate catalyzed element or substrate (e.g., a diesel oxidation catalyst).

Referring now to FIG. 2, the inlet conduit 20*a* may be configured and arranged to communicate exhaust gas with the inlet port 32*a* of the housing 12. The inlet conduit 20*a* may be rigidly fluidly connected with the inlet port 32*a*, for example via a welded connection between the inlet conduit 20*a* and the tubular wall 36*a* around the circumference of the inlet port 32*a*. In the embodiment of FIG. 2, the inlet conduit 20*a* is connected with the tubular wall 36*a* proximate the opening 30*a* and is configured so that a flow path 40*a* of exhaust gas through the inlet conduit 20*a* and into the inlet port 32*a* enters inlet conduit 20*a* in a direction generally parallel to the longitudinal axis A1 and then exits inlet conduit 20*a* (and enters the inlet port 32*a*) in a direction generally transverse to the longitudinal axis A1.

The inlet conduit 20*a* may generally define two substantially perpendicular axes, a first axis A2*a* and a second axis A2*b* (see FIG. 5), and may form a flow path 40*a* arranged generally along the first axis A2*a* and the second axis A2*b*. The first axis A2*a* may extend in a direction generally parallel to the longitudinal axis A1, while the second axis A2*b* may extend in a direction generally transverse to the longitudinal axis A1. In such a configuration, exhaust gas transmitted through the inlet conduit 20*a* into the housing 12 substantially reverses direction to flow generally along the flow path 24.

The inlet conduit 20*a* may include an inlet port 44*a* arranged generally along the first axis A2*a* of the inlet conduit 20*a* through which the flow of exhaust gas enters inlet conduit 20*a* and an outlet port 48*a* arranged generally along the second axis A2*b* of the inlet conduit 20*a* through which the flow of exhaust gas exits inlet conduit 20*a*. The inlet port 44*a* may have a generally circular cross-section 46*a* with an inner diameter D4*a* (for example measured in a direction generally transverse with the longitudinal axis A1 of the housing 12) and an associated cross-sectional area through which exhaust gas may flow.

The outlet port 48*a* may be arranged proximate the inlet port 32*a* of the housing 12 and may have a generally elongated cross-section 50*a* proximate the inlet port 32*a*. The cross-section 50*a* of the outlet port 48*a* may have an inner diameter or length L3*a*, for example measured in a direction generally parallel with the longitudinal axis A1 of the housing 12. As shown in the embodiment of FIG. 2, the inner length L3*a* of the cross-section 50*a* of the outlet port 48*a* may be smaller than the inner diameter D4*a* of the cross-section 46*a* of the inlet port 44*a*.

The cross-section 50*a* of the outlet port 48*a* may have an internal width W3*a* (FIG. 5), for example measured in a direction generally perpendicular to the inner length L3*a*. The internal width W3*a* of the cross-section 50*a* may be greater than the inner length L3*a* of the cross-section 50*a* such that the cross-section 50*a* has an elongated configuration. The internal width W3*a* of the cross-section 50*a* may also be greater than the inner diameter D4*a* of the cross-section 46*a* of the inlet port 44*a*, In one embodiment, the internal width W3*a* of the cross-section 50*a* may be equal to or greater than 40 percent of the inner diameter D1 of the tubular wall 36*a* of the housing 12. For example, the internal width W3*a* of the cross-section 50*a* may be equal to or greater than 50 percent of the inner diameter D1 of the tubular wall 36*a* of the housing 12. In another embodiment, the internal width W3*a* of the cross-section 50*a* may be equal to or greater than 60 percent of the inner diameter D1 of the tubular wall 36*a* of the housing 12. In another embodiment, the internal width W3*a* of the cross-section 50*a* may be equal to or greater than 70 percent of the inner diameter D1 of the tubular wall 36*a* of the housing 12. In one example, the internal width W3*a* could be approximately 175 mm, while the inner diameter D1 of the tubular wall 36*a* of the housing 12 could be approximately 245 mm, so that the internal width W3*a* of the cross-section 50*a* would be approximately equal to 71 percent of the inner diameter D1 of the tubular wall 36*a* of the housing 12. In yet another embodiment, the internal width W3*a* of the cross-section 50*a* may be equal to or greater than 80 percent of the inner diameter D1 of the tubular wall 36*a* of the housing 12.

Figure 5:
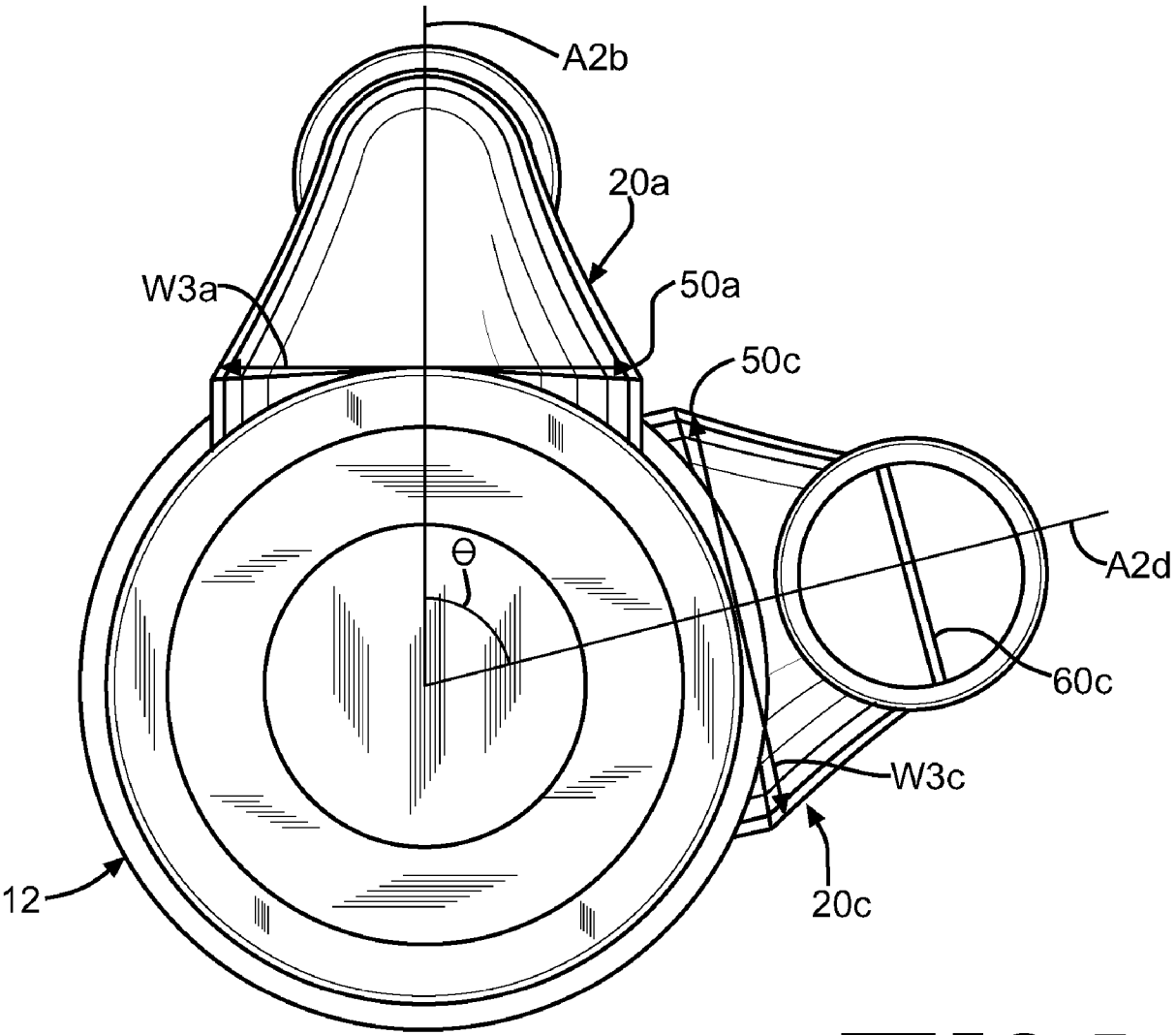
FIG. 5 is an end view of the exhaust treatment system of FIG. 1.

According to one exemplary embodiment, the transition between the inlet port 44*a* and the outlet port 48*a* may be a generally gradual transition. For example, as best seen in FIG. 5, the increase in the width of the inlet conduit 20*a* from inlet port 44*a* (where the width is equal to D4*a*) to the outlet port 48*a* (where the width is equal to W3*a*) may be substantially proportional to the distance from the housing 12 (e.g., the rate of change in the width of the inlet conduit 20*a* may have a substantially constant slope). Thus, the closer a portion of the inlet conduit 20*a* is to housing 12, the wider it may become. This creates the appearance of a generally straight taper as viewed from an end of the housing 12. Similarly, as best seen in FIG. 2, a flow path length dimension of inlet conduit 20*a* gradually decreases from the length L5*a* (which is equal to D4*a*) at the inlet port 44*a*, to a length L4*a* at a point between the inlet port 44*a* and the outlet port 48*a*, and then to a length L3*a* at the the outlet port 48*a*. Thus, as exhaust flow moves from the inlet port 44*a* to the outlet port 48*a*, the flow path length dimension gradually becomes smaller. For example, the decrease in the flow path length dimension of the inlet conduit 20*a* may be proportional to the distance along the flow path within the inlet conduit 20*a* (e.g., the rate of change of the flow path length dimension may have a substantially constant slope). In other embodiments, the increase in the width and the decrease in the flow path length dimension may be other than proportional or linear. For example, the rate of change (or slope) of the width or flow path length dimensions may change at different locations along the inlet conduit 20*a*.

The cross-sectional area of the cross-section 50*a* of the outlet port 48*a* may be greater than the cross-sectional area of the cross-section 46*a* of the inlet port 44*a*, A cross-sectional area ratio AR may be defined by the cross-sectional area of the cross-section 50*a* divided by the cross-sectional area of the cross-section 46*a*. In one embodiment, the cross-sectional area ratio AR may be equal to or greater than about 1.1. In another embodiment, the cross-sectional area ratio AR may be equal to or greater than about 1.2. In another embodiment, the cross-sectional area ratio AR may be equal to or greater than about 1.5. In a further embodiment, the cross-sectional area ratio AR may be in the range of about 1.6 to 1.8, for example about 1.7. Controlling the cross-sectional area ratio AR helps control backpressure on the engine as well as velocity of exhaust flowing into the housing 12. The cross-sectional area ratio AR also helps control flow distribution into the housing 12 and toward the treatment element 16.

The inlet conduit 20*a* may be coupled to the housing 12 in an orientation in which the position of the cross-section 46*a* along the longitudinal axis A1 of the housing 12 is closer to the outlet conduit 20*c* than the position of the second cross-section 50*a* along the longitudinal axis A1 (e.g., such as when the first axis A2*a* of the inlet conduit 20*a* is substantially parallel to the longitudinal axis A1 of the housing 12). For example, the inlet conduit 20*a* may be configured such that there is a distance X1 between a projection P1 of the cross-section 46*a* onto the longitudinal axis A1 and a projection P2 of the cross-section 50*a* onto the longitudinal axis A1. The value of the distance X1 may be varied depending on packaging constraints and the design of any components that may be coupled to the inlet conduit 20*a*. In one embodiment, the distance X1 may be less than 77 mm. In another embodiment, the distance X1 may be equal to or between 77 and 100 mm. In another embodiment, the distance X1 may be equal to or between 100 and 125 mm. In a further embodiment, the distance X1 may be greater than 125 mm.

In various embodiments, the dimensions, arrangements, features, and configurations of the outlet conduit 20*c* (e.g., A2*c*, D4*c*, L3*c*, L4*c*, L5*c*, P3, P4, W3*c*, 40*c*, 44*c*, 46*c*, 48*c*, and 50*c*, X3, etc.) may be substantially identical to those of the inlet conduit 20*a* described above. FIGS. 1-5 show an embodiment in which the outlet conduit 20*c* is rotated 180 degrees compared with the orientation of the inlet conduit 20*a* and attached to the outlet port 32*c* in substantially the same way as the inlet conduit 20*a* is arranged and connected with the inlet port 32*a*. Of course, alternative embodiments may be dimensioned, arranged, or configured differently.

Figure 4:
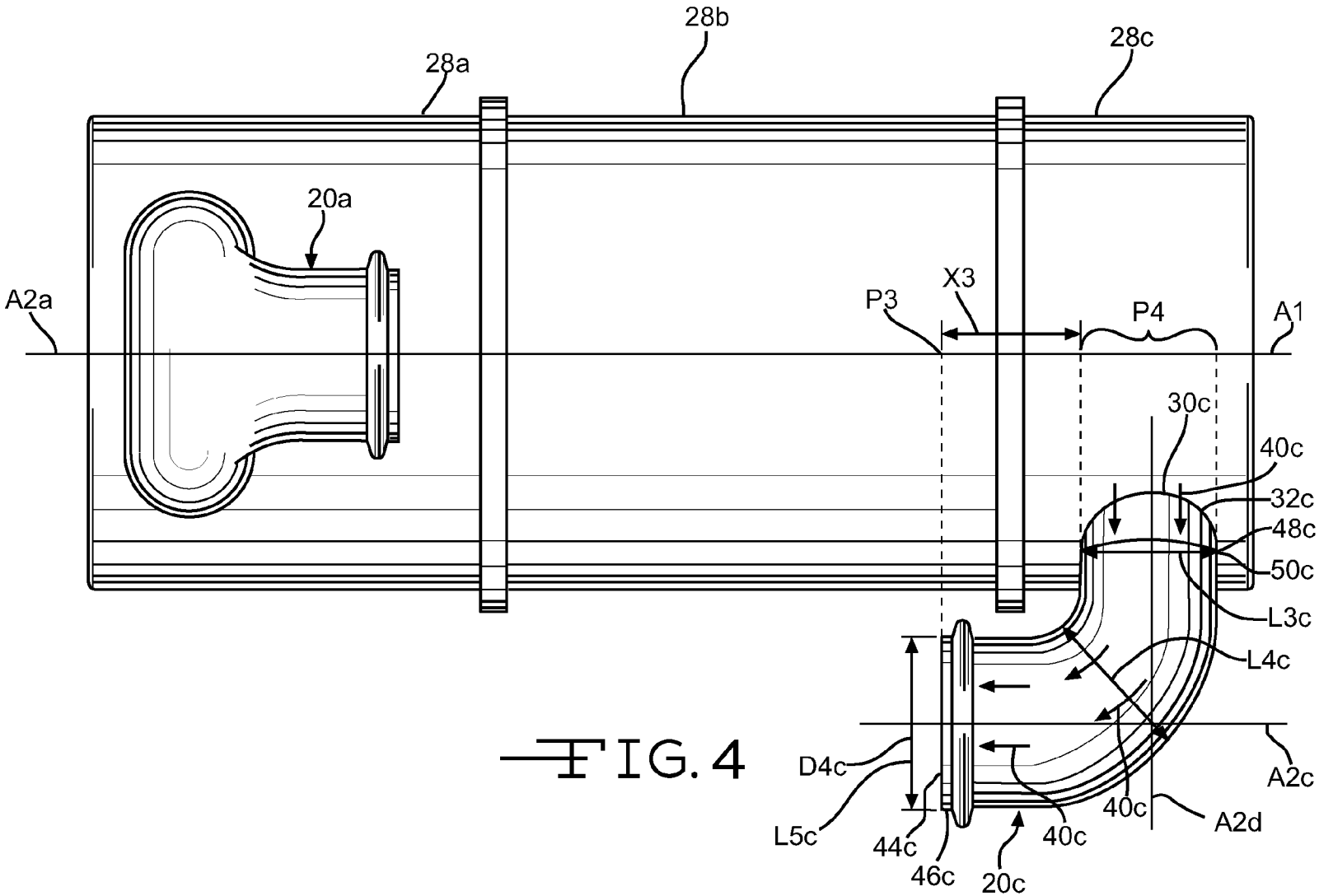
FIG. 4 is a top view of the exhaust treatment system of FIG. 1.

Referring now to FIG. 4, the outlet conduit 20*c* may be configured and arranged to communicate exhaust gas with the outlet port 32*c* of the housing 12. The outlet conduit 20*c* may be rigidly fluidly connected with the outlet port 32*c*, for example via a welded connection between the outlet conduit 20*c* and the tubular wall 36*c* around the circumference of the outlet port 32*c*. In the embodiment of FIG. 4, the outlet conduit 20*c* is connected with the tubular wall 36*c* proximate the opening 30*c* and is configured so that a flow path 40*c* of exhaust gas through the outlet port 32*c* of the housing 12 and into the outlet conduit 20*c* enters outlet conduit 20*c* in a direction generally transverse to the longitudinal axis A1 and then exits outlet conduit 20*c* in a direction generally parallel to the longitudinal axis A1.

The outlet conduit 20*c* may generally define two substantially perpendicular axes, a first axis A2*c* and a second axis A2*d*, and may form a flow path 40*c* arranged generally along the second axis A2*d* and the first axis A2*c*. The first axis A2*c* may extend in a direction generally parallel to the longitudinal axis A1, while the second axis A2*d* may extend in a direction generally transverse to the longitudinal axis A1. In such a configuration, exhaust gas transmitted from housing 12 and into the outlet conduit 20*c* substantially reverses direction to flow generally along the first axis A2*c*.

The outlet conduit 20*c* may include an inlet port 48*c* arranged generally along the second axis A2*d* of the outlet conduit 20*c* through which the flow of exhaust gas enters outlet conduit 20*c* and an outlet port 44*c* arranged generally along the first axis A2*c* of the outlet conduit 20*c* through which the flow of exhaust gas exits outlet conduit 20*c*. The outlet port 44*c* may have a generally circular cross-section 46*c* with an inner diameter D4*c* (for example measured in a direction generally transverse with the longitudinal axis A1 of the housing 12) and an associated cross-sectional area through which exhaust gas may flow.

The inlet port 48*c* may be arranged proximate the outlet port 32*c* of the housing 12 and may have a generally elongated cross-section 50*c* proximate the outlet port 32*c*. The cross-section 50*c* of the inlet port 48*c* may have an inner diameter or length L3*c*, for example measured in a direction generally parallel with the longitudinal axis A1 of the housing 12. As shown in the embodiment of FIG. 4, the inner length L3*c* of the cross-section 50*c* of the inlet port 48*c* may be smaller than the inner diameter D4*c* of the cross-section 46*c* of the outlet port 44*c*.

The cross-section 50*c* of the inlet port 48*c* may have an internal width W3*c* (FIG. 5), for example measured in a direction generally perpendicular to the inner length L3*c*. The internal width W3*c* of the cross-section 50*c* may be greater than the inner length L3*c* of the cross-section 50*c* such that the cross-section 50*c* has an elongated configuration. The internal width W3*c* of the cross-section 50*c* may also be greater than the inner diameter D4*c* of the cross-section 46*c* of the outlet port 44*c*. In one embodiment, the internal width W3*c* of the cross-section 50*c* may be equal to or greater than 40 percent of the inner diameter D3 of the tubular wall 36*c* of the housing 12. For example, the internal width W3*c* of the cross-section 50*c* may be equal to or greater than 50 percent of the inner diameter D3 of the tubular wall 36*c* of the housing 12. In another embodiment, the internal width W3*c* of the cross-section 50*c* may be equal to or greater than 60 percent of the inner diameter D3 of the tubular wall 36*c* of the housing 12. In another embodiment, the internal width W3*c* of the cross-section 50*c* may be equal to or greater than 70 percent of the inner diameter D3 of the tubular wall 36*c* of the housing 12. In one example, the internal width W3*c* could be approximately 175 mm, while the inner diameter D3 of the tubular wall 36*c* of the housing 12 could be approximately 245 mm, so that the internal width W3*c* of the cross-section 50*c* would be approximately equal to 71 percent of the inner diameter D3 of the tubular wall 36*c* of the housing 12. In yet another embodiment, the internal width W3*c* of the cross-section 50*c* may be equal to or greater than 80 percent of the inner diameter D3 of the tubular wall 36*c* of the housing 12.

According to one exemplary embodiment, the transition between the outlet port 44*c* and the inlet port 48*c* may be a generally gradual transition. For example, as best seen in FIG. 5, the increase in the width of the outlet conduit 20*c* from the outlet port 44*c* (where the width is equal to D4*c*) to the inlet port 48*c* (where the width is equal to W3*c*) may be substantially proportional to the distance from the housing 12 (e.g., the rate of change in the width of the outlet conduit 20*c* may have a substantially constant slope). Thus, the closer a portion of the outlet conduit 20*c* is to housing 12, the wider it may become. This creates the appearance of a generally straight taper as viewed from an end of the housing 12. Similarly, as best seen in FIG. 4, a flow path length dimension of outlet conduit 20*c* gradually increases from a length L3*c* at the inlet port 48*c*, to a length L4*c* at a point between the outlet port 44*c* and the inlet port 48*c*, and then to a length L4*c* (which is equal to D4*c*) at the outlet port 44*c*. Thus, as exhaust flow moves from the inlet port 48*c* to the outlet port 44*c*, the flow path length dimension gradually becomes larger. For example, the increase in the flow path length dimension of the outlet conduit 20*c* may be proportional to the distance along the flow path within the outlet conduit 20*c* (e.g., the rate of change of the flow path length dimension may have a substantially constant slope). In other embodiments, the increase in the width from the outlet port 44*c* to the inlet port 48*c* and the increase in the flow path length dimensions from the inlet port 48*c* to the outlet port 44*c* may be other than proportional or linear. For example, the rate of change (or slope) of the width or flow path length dimensions may change at different locations along the outlet conduit 20*c*.

The cross-sectional area of the cross-section 50*c* of the inlet port 48*c* may be greater than the cross-sectional area of the cross-section 46*c* of the outlet port 44*c*. A cross-sectional area ratio AR may be defined by the cross-sectional area of the cross-section 50*c* divided by the cross-sectional area of the cross-section 46*c*. In one embodiment, the cross-sectional area ratio AR may be equal to or greater than about 1.1. In another embodiment, the cross-sectional area ratio AR may be equal to or greater than about 1.2. In another embodiment, the cross-sectional area ratio AR may be equal to or greater than about 1.5. In a further embodiment, the cross-sectional area ratio AR may be in the range of about 1.6 to 1.8, for example about 1.7. Controlling the cross-sectional area ratio AR helps control backpressure on the engine as well as velocity of exhaust flowing out of the housing 12.

The outlet conduit 20*c* may be coupled to the housing 12 in an orientation in which the position of the cross-section 46*c* along the longitudinal axis A1 of the housing 12 is closer to the inlet conduit 20*a* than the position of the second cross-section 50*c* along the longitudinal axis A1 (e.g., such as when the first axis A2*c* of the outlet conduit 20*c* is substantially parallel to the longitudinal axis A1 of the housing 12). For example, the outlet conduit 20*c* may be configured such that there is a distance X3 between a projection P3 of the cross-section 46*c* onto the longitudinal axis A1 and a projection P4 of the cross-section 50*c* onto the longitudinal axis A1. The value of the distance X3 may be varied depending on packaging constraints and the design of any components that may be coupled to the outlet conduit 20*c*. In one embodiment, the distance X3 may be less than 77 mm. In another embodiment, the distance X3 may be equal to or between 77 and 100 mm. In another embodiment, the distance X3 may be equal to or between 100 and 125 mm. In a further embodiment, the distance X3 may be greater than 125 mm.

To help control the flow of exhaust through the inlet conduit 20*a* and/or the outlet conduit 20*c*, either or both of the inlet conduit 20*a* and the outlet conduit 20*c* may optionally include a vane or vanes, such as vane 60*c* illustrated in FIGS. 1 and 5. In one embodiment, the vane 60*c* is a substantially flat plate positioned within outlet conduit 20*c* near outlet port 44*c* and arranged in an orientation substantially parallel to cross-section 50*c*. In other embodiments, one or more vanes may be placed in one or more locations within the outlet conduit 20*c* and/or the inlet conduit 20*a* (e.g., near the inlet port 44*a* and/or the outlet port 48*a* of inlet conduit 20*a*, or near the outlet port 44*c* and/or the inlet port 48*c* of outlet conduit 20*c*). In other embodiments, the vanes may take any one or more of a variety of different shapes, sizes, and configurations.

Referring now to FIG. 5, the inlet and outlet conduits 20*a* and 20*c* may be positioned at various angular positions around the circumference of housing 12 relative to one another depending on the circumstances or demands of a particular application. For example, the inlet conduit 20*a* and the outlet conduit 20*c* may be positioned around housing 12 such that the second axis A2*b* of the inlet conduit 20*a* and the second axis A2*d* of the outlet conduit 20*c* are oriented at an angle θ relative to one another. According to various exemplary and alternative embodiments, the angle θ may be any angle between (and including) 0 degrees and 360 degrees. In one embodiment, the angle θ may be between (and may include) 0 and 90 degrees. In another embodiment, the angle θ may be between (and may include) 90 and 180 degrees. In another embodiment, the angle θ may be between (and may include) 180 and 270 degrees. In a further embodiment, the angle θ may be between (and may include) 270 and 390 degrees.

The inlet conduit 20*a* may have substantially the same inner diameter measurements D4*a*, L3*a*, W3*a* as the inner diameter measurements D4*c*, L3*c*, W3*c* of the outlet conduit 20*c*. Thus, in one embodiment, the same piece-part may be used to create the inlet conduit 20*a* and the outlet conduit 20*c*. This may allow for cost reductions that are often associated with increased volumes. By having the ability to vary the rotational arrangements of such piece parts 20*a*, 20*c* during assembly, differing connection requirements or housing position requirements may be accommodated by fewer housing 12 configurations, for example to accommodate different OEM truck or machine manufacturing specifications such as desired pierce-point (connection) distances between the inlet conduit 20*a* and the outlet conduit 20*c* for connecting an exhaust treatment system 10 to an engine exhaust system.

Figure 6:
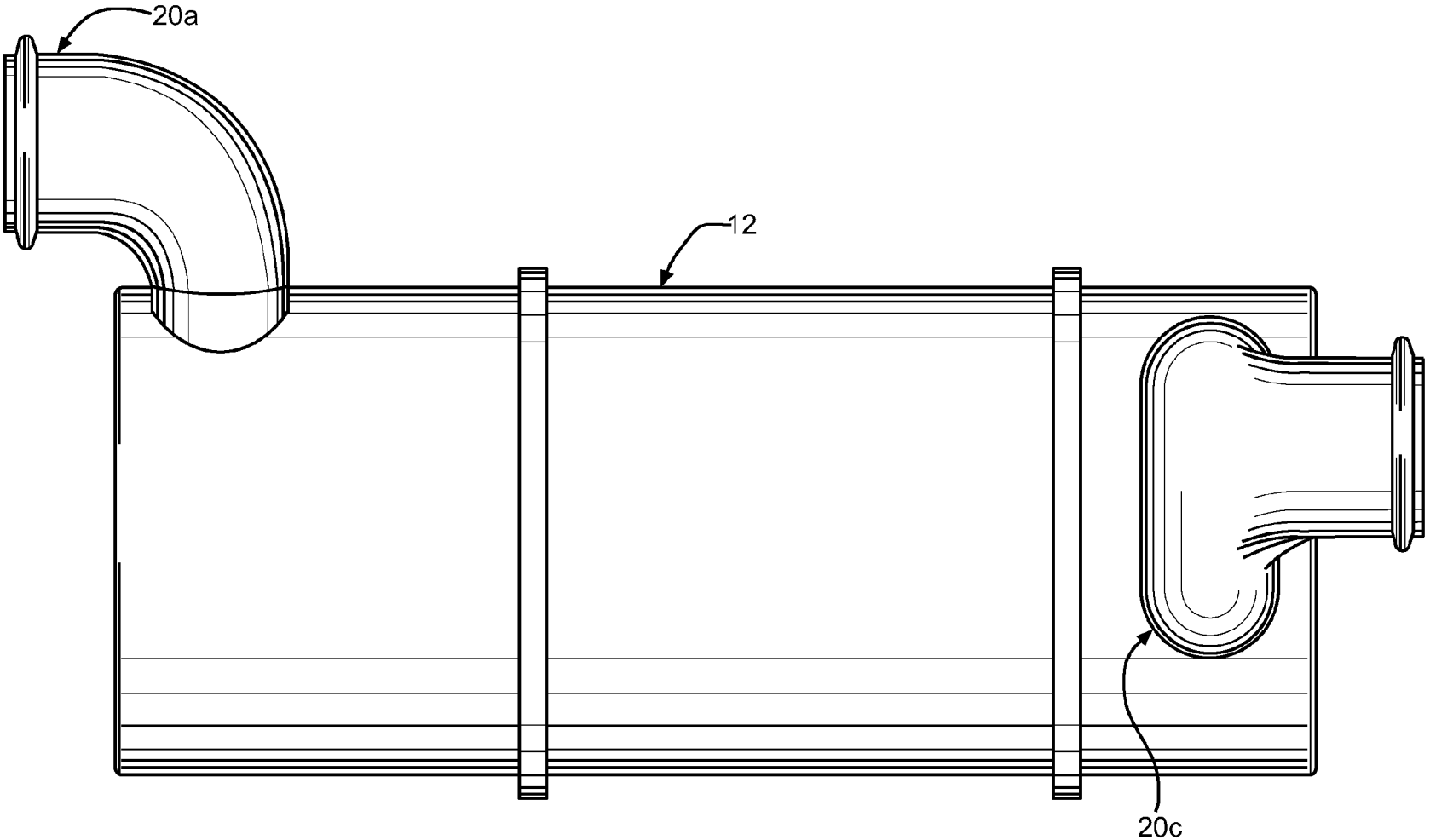
FIG. 6 is a side view of an exhaust treatment system according to another exemplary embodiment.

As illustrated in FIGS. 2 and 6, the configuration of the exhaust treatment system 10 may be selectively varied during assembly by rotating either or both of the inlet conduit 20*a* and the outlet conduit 20*c* 180 degrees between a position in which the conduit faces inwardly (the position both inlet conduit 20*a* and outlet conduit 20*c* are in in FIG. 2) and a position in which the conduit faces outwardly (the position both inlet conduit 20*a* and outlet conduit 20*c* are in in FIG. 6). Thus, the exhaust treatment system 10 may be arranged in a configuration where both the inlet conduit 20*a* and the outlet conduit 20*c* face inwardly (FIG. 2), where both the inlet conduit 20*a* and the outlet conduit 20*c* face outwardly (FIG. 6), where the inlet conduit 20*a* faces inwardly and the outlet conduit 20*c* faces outwardly, or where the inlet conduit 20*a* faces outwardly and the outlet conduit 20*c* faces inwardly.

INDUSTRIAL APPLICABILITY

With at least some of the foregoing arrangements and embodiments discussed herein (e.g., FIG. 2), using an inlet conduit 20*a* that is formed to have a shorter inner diameter L3*a* (connecting to the housing 12 at the inlet port 32*a*) than the inner diameter D4*a* (connecting, in one embodiment, to an exhaust line from an engine), an axial length of the housing 12 (for example as measured along the longitudinal axis A1) may be minimized while accommodating a relatively large exhaust line (not shown), such as an exhaust line having a connection diameter the same as the inner diameter D4*a* of the inlet conduit 20*a*. Using an outlet conduit 20*c* such as that described hereinabove relative to FIG. 4, for example, may facilitate similar axial length minimization.

Moreover, it is expected that, in one embodiment, by using an inlet conduit 20*a* having a relatively wide opening (e.g., as indicated via dimension W3*a* in FIG. 5 compared with the dimension D4*a* shown in FIG. 2) for transmitting exhaust gas into the inlet port 32*a* of the housing 12, distribution of exhaust gas to a fluid treatment element 16 may be more effective since exhaust gas may form a relatively wide fluid path moving from the inlet conduit 20*a* and into the housing 12, as compared with an inlet conduit 20*a* having a more narrow opening for transmitting exhaust gas into the inlet port 32*a*. Thus, exhaust gas being transmitted into the housing 12 from the inlet conduit 20*a* may be more evenly distributed across the face of an exhaust treatment element 16 held within the housing 12 since the inlet conduit 20*a* (and the inlet port 32*a*) facilitates a wider fluid path entering the housing 12. Moreover, positive exhaust flow velocity effects may be achieved with such an arrangement.

Further, it is expected that, in one embodiment, by increasing the cross-sectional area of the inlet conduit 20*a* from a first cross-sectional area at a first cross-section 46*a* to a larger (for example wider) cross-sectional area at a second cross-section 48*a*, backpressure on the engine exhaust line (e.g., downstream of an engine combustion chamber) would be reduced, as compared with an inlet conduit having a relatively constant or decreasing cross-sectional area moving from the first cross-section to the second cross-section and into the inlet port of the housing. Moreover, such backpressure benefits are expected as well by using an outlet conduit 20*c* with differing first and second cross-sections 48*c*, 46*c* such as that described hereinabove relative to FIG. 4 for example.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A system for treating exhaust gas from an engine, comprising:

a housing having an inlet port and an outlet port and defining a flow path between the inlet port and the outlet port;

a fluid treatment element arranged in the flow path of the housing and configured to treat exhaust gas;

a conduit fluidly connected with at least one of the inlet port and the outlet port of the housing, the conduit including a first port having a first axis and a second port having a second axis substantially perpendicular to the first axis, the first port having a first cross-section with an inner diameter, the second port having a generally elongated second cross-section with an inner width and an inner length;

wherein the inner length of the second cross-section of the conduit is smaller than the inner diameter of the first cross-section of the conduit, and the inner width of the second cross-section is greater than the inner diameter of the first cross-section.

2. The system of claim 1, wherein the first cross-section is generally circular.

3. The system of claim 1, wherein the first cross-section of the first port has a first cross-sectional area and the second cross-section of the second port has a second cross-sectional area greater than the first cross-sectional area.

4. The system of claim 3, wherein a cross-sectional area ratio is defined by the second cross-sectional area divided by the first cross-sectional area, the cross-sectional area ratio being equal to or greater than about 1.1.

5. The system of claim 4, wherein the cross-sectional area ratio is equal to or greater than about 1.2.

6. The system of claim 5, wherein the cross-sectional area ratio is equal to or greater than about 1.5.

7. The system of claim 6, wherein the cross-sectional area ratio is in the range of about 1.6 to about 1.8.

8. The system of claim 1, wherein the conduit is an inlet conduit fluidly connected with the inlet port of the housing, and further comprising an outlet conduit fluidly connected to the outlet port of the housing, the outlet conduit including a third port having a third axis and a fourth port having a fourth axis substantially perpendicular to the third axis, the third port having a third cross-section with an inner diameter, the fourth port having a general elongated fourth cross-section with an inner width and an inner length.

9. The system of claim 8, wherein the inner length of the fourth cross-section of the outlet conduit is smaller than the inner diameter of the third cross-section of the outlet conduit, and the inner width of the fourth cross-section is greater than the inner diameter of the third cross-section.

10. The system of claim 8, wherein the first axis of the inlet conduit and the third axis of the outlet conduit are parallel.

11. The system of claim 10, wherein the housing defines a longitudinal axis and wherein the first axis and the third axis are parallel to the longitudinal axis of the housing.

12. The system of claim 8 wherein the inlet conduit and the outlet conduit are angularly spaced apart around the circumference of the housing relative to one another.

13. The system of claim 1, wherein:

the flow path in which the fluid treatment element is arranged is defined at least in part by a tubular wall of the housing, the tubular wall having an inner diameter transverse to the flow path; and the inner width of the second cross-section of the conduit is equal to or greater than about 40 percent of the inner diameter of the tubular wall of the housing.

14. The system of claim 13, wherein the inner width of the second cross-section of the conduit is equal to or greater than about 60 percent of the inner diameter of the tubular wall of the housing.

15. The system of claim 1, wherein the conduit is an outlet conduit fluidly connected with the outlet port of the housing.

16. A system for treating exhaust gas from an engine, comprising:

a housing having an inlet port and an outlet port and defining a flow path between the inlet port and the outlet port, the housing defining a longitudinal axis;

a fluid treatment element arranged in the flow path of the housing and configured to treat exhaust gas; and a conduit fluidly connected with one of the inlet port and the outlet port of the housing, the conduit having a first port and a second port, the first port having a first cross-section defined by an inner diameter and the second port having a second cross-section defined by an inner width and an inner length, the first cross-section being provided in a first plane and the second cross-section being provided in a second plane substantially perpendicular to the first plane;

wherein the inner width of the second cross-section is larger than the inner length of the second cross-section; and wherein a projection of the first cross-section onto the longitudinal axis of the housing is closer to the other one of the inlet port and the outlet port than a projection of the second cross-section on the longitudinal axis.

17. The system of claim 16, wherein the inner length of the second cross-section of the conduit is smaller than the inner diameter of the first cross-section of the conduit, and the inner width of the second cross-section is greater than the inner diameter of the first cross-section.

18. The system of claim 16, wherein the fluid treatment element is a diesel particulate filter.

19. The system of claim 16, wherein the fluid treatment element is catalyzed.

20. The system of claim 16, wherein the first cross-section of the first port has a first cross-sectional area and the second cross-section of the second port has a second cross-sectional area, and wherein a cross-sectional area ratio is defined by the second cross-sectional area divided by the first cross-sectional area, the cross-sectional area ratio being in the range of about 1.1 to about 1.8.

* * * * *